United States Patent [19]

Adams

[11] 4,388,886

[45] Jun. 21, 1983

[54] REDUCED LOAD PRESSER BAR

[75] Inventor: Kenneth D. Adams, Madison, N.J.

[73] Assignee: The Singer Company, Stamford, Conn.

[21] Appl. No.: 331,692

[22] Filed: Dec. 17, 1981

[51] Int. Cl.[3] ..... D05B 29/02

[52] U.S. Cl. ..... 112/237

[58] Field of Search ..... 112/235–238, 112/60, 61

[56] References Cited

U.S. PATENT DOCUMENTS 2,139,426 12/1938 Toskey et al. ..... 112/237 X
2,422,820 6/1947 Best ..... 112/237
3,294,047 4/1965 Graham .
3,329,115 4/1965 Ciecior .
4,342,272 8/1982 Transue et al. ..... 112/237

FOREIGN PATENT DOCUMENTS 55-16671 5/1980 Japan .

*Primary Examiner*—Werner H. Schroeder
*Assistant Examiner*—Andrew M. Falik
*Attorney, Agent, or Firm*—David L. Davis; Robert E. Smith; Edward L. Bell

[57] ABSTRACT

A reduced load presser bar mechanism having a separate secondary spring that may easily be disengaged or engaged by the operator to counter balance the biasing force of the primary presser bar spring thereby reducing the normal force exerted by the presser foot on the work piece to near zero.

5 Claims, 7 Drawing Figures

REDUCED LOAD PRESSER BAR

DESCRIPTION

BACKGROUND OF THE INVENTION

This invention relates to sewing machines and in particular to presser bar mechanisms therefor.

Sewing machines that are intended for use in mending, darning, and embroidery applications, or the like, require that the pressure exerted by the presser foot on the work piece be reduced to near zero while maintaining the presser foot in contact with the work piece. This allows complete freedom of movement when feeding the work piece while, at the same time, maintaining the work piece in contact with the work supporting surface to prevent flagging.

Prior art devices accomplish this generally by means of a counter balance spring arranged in opposition to the spring that urges the presser bar downwardly toward the work piece. See, for example, U.S. Pat. No. 3,329,115, issued July 4, 1967 to Ciecior. Such devices, however, have no convenient way to disengage the counter balance spring when it is desired to resume normal sewing. Other prior art devices, such as that disclosed in U.S. Pat. No. 3,294,047, issued Dec. 27, 1966 to Graham, disengage the primary spring that urges the presser bar downwardly for normal sewing but permits a secondary spring that also urges the presser bar downwardly, but with a lighter pressure, to control the pressure exerted by the presser foot on the work piece. This construction, however, results in a complex mechanism that is costly to manufacture and maintain.

It is therefore an object of this invention to provide a reliable device that is inexpensive to manufacture for counter balancing the effect of the presser bar biasing spring.

It is another objective of this invention to provide a means for easily engaging and disengaging the counter balancing device.

Other objects and advantages of the invention will become apparent through reference to the accompanying drawings and descriptive matter which illustrate a preferred embodiment of this invention.

SUMMARY OF THE INVENTION

According to the present invention there is provided a presser bar mechanism for a sewing machine having a frame and a work supporting surface. The presser bar mechanism includes a cylindrical presser bar reciprocally movable in its axial direction; a presser foot attached to one end of said presser bar; means for urging the presser bar in a direction toward the work supporting surface; and counter balance means for urging the presser bar in a direction away from the work supporting surface. The counter balance means comprises: an actuating member, an abutting surface, a control means and a spring. The abutting surface is attached to the presser bar for reciprocal movement therewith in a predefined path. The control means is arranged for positioning the actuating member into either of two positions, in the first position the actuating member is disposed within the predefined path of the abutting surface, in the second position the actuating member is disposed outside of the predefined path. The spring is arranged to cooperate with the actuating member so that when in the first position, the actuating member engages the abutting surface thereby urging the presser bar in the direction away from the work supporting surface.

BRIEF DESCRIPTION OF THE DRAWINGS

In order that the invention be more fully understood, it will now be described, by way of example, with reference to the following drawings in which.

DESCRIPTION OF THE PREFERRED EMBODIMENT

Figure 2:
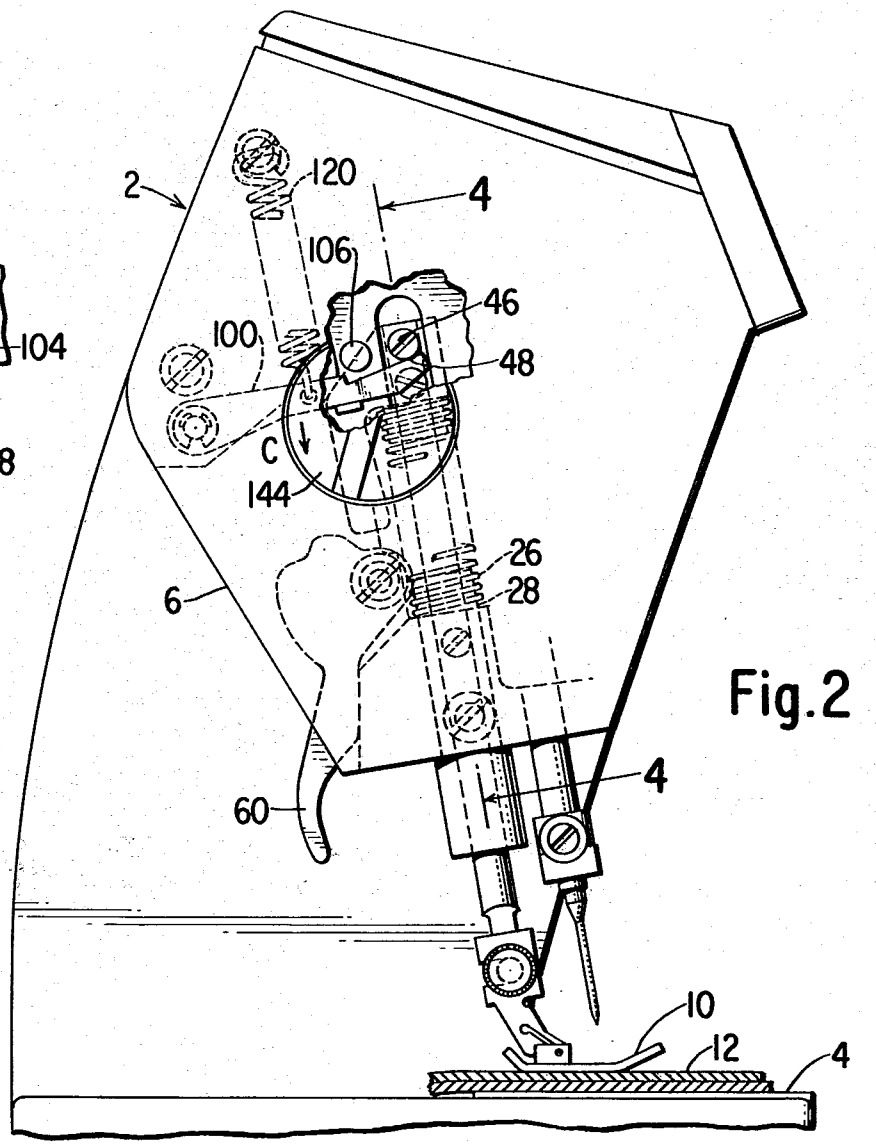
FIG. 2 is a side view similar to that of FIG. 1, showing the counter balancing mechanism engaged.

Referring to FIGS. 1 through 4 there is shown a sewing machine 2 having a work supporting surface 4, a head 6, a presser bar 8 journalled in the head 6 for reciprocal motion toward and away from the work supporting surface 4, and a presser foot 10 removably attached to the presser bar 8 for engaging the work piece 12.

The presser bar 8 has attached to its upper end a collar 20 which is securely held in place by a set screw 22. The collar 20 has a threaded portion 24 projecting downwardly upon which is securely threaded one end of a helical tension spring 26. The other end of the helical tension spring 26 is securely threaded onto a bushing 28 which is rigidly attached to the frame 30 of the sewing machine by the set screw 32. With this construction, the helical tension spring 26 tends to pull the collar 20 downwardly, as viewed in FIGS. 3 and 4, thereby urging the presser bar 8 downwardly toward the work supporting surface 4.

Figure 3A:
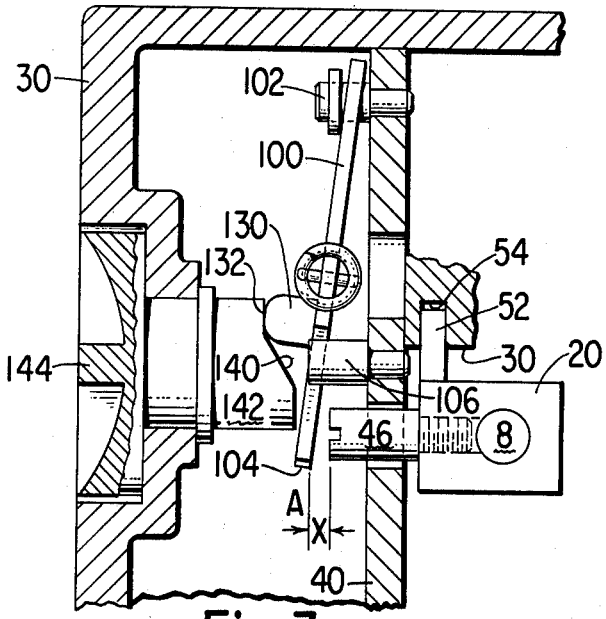
FIG. 3*a* is a top view of the mechanism shown in FIG. 3.
Figure 4A:
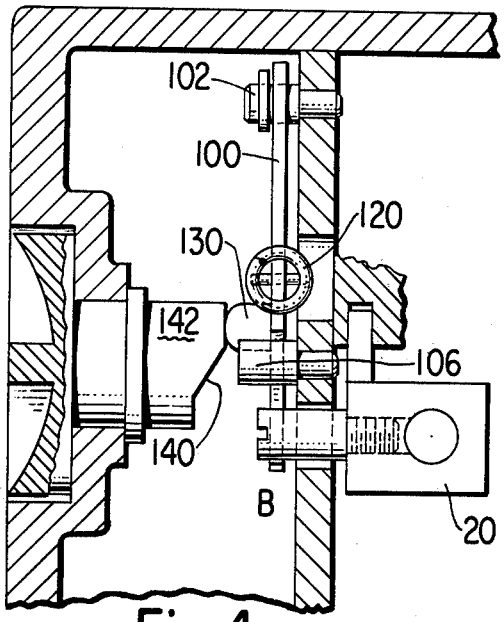
FIG. 4*a* is a top view of the mechanism shown in FIG. 4.
Figure 3:
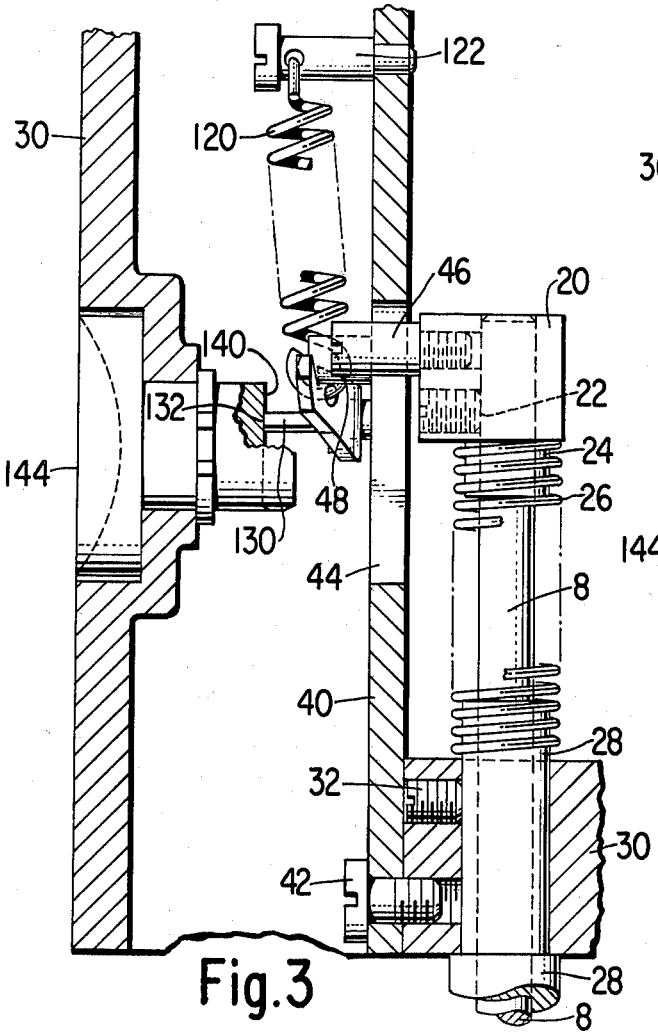
FIG. 3 is a section view taken along the line 3—3 of FIG. 1.
Figure 4:
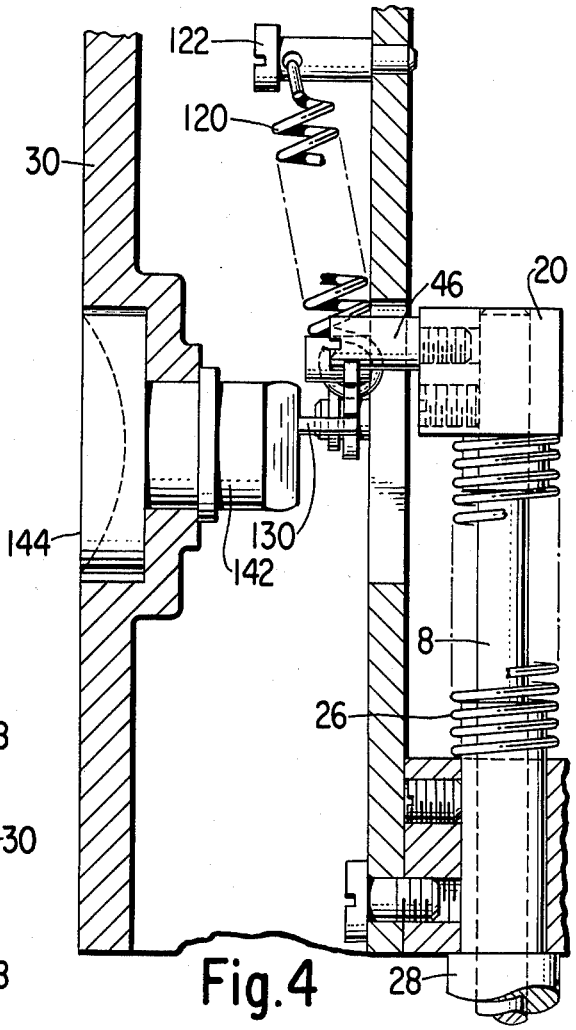
FIG. 4 is a section view taken along the line 4—4 of FIG. 2.

A bracket 40 is securely fastened to the frame 30 with suitable screw fasteners 42, as shown in FIGS. 3 and 4. An elongated hole 44 is formed in the bracket 40 so that its longitudinal axis is parallel to the longitudinal axis of the presser bar 8 and adjacent thereto. A guide pin 46, rigidly attached to the collar 20, is arranged to project completely through the elongated hole 44, its free end projecting substantially beyond the bracket 40. An abutting surface 48, located on the lower surface of the free end of the guide pin 46, is positioned on the side of the bracket 40 which is opposite that of the side adjacent the presser bar 8. The elongated hole 44 is made sufficiently large so that the guide pin 46 may undergo unobstructed reciprocal motion along with the presser bar 8.

Figure 1A:
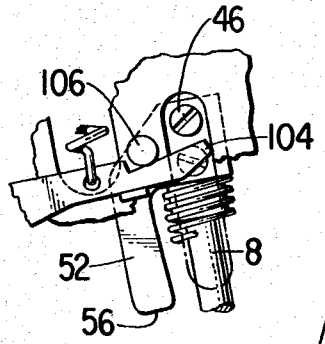
FIG. 1*a* is a side view of a portion of FIG. 1 showing the presser bar in its full up position.

The collar 20 has attached thereto a tang 52 which is turned downwardly, as viewed in FIG. 1*a*. The tang 52 slidingly engages a slot 54, see FIG. 3*a*, formed in the frame 30 for preventing rotation of the presser bar 8. The lower end of the tang 52 has a lifting surface 56 which is engaged by the cam 58 of the lifting lever 60 for raising the presser bar 8 and thereby lifting the presser foot off the work piece, as shown in phantom lines in FIG. 1.

An actuating member 100 is pivotally attached to the bracket 40 with a suitable fastener 102. The fastener 102 allows the free end 104 of the actuating member 100 to undergo a substantial amount of horizontal movement, as in indicated by the two positions A and B shown in FIGS. 3*a* and 4*a*, as well as vertical movement as viewed in FIGS. 1 and 2. A stop pin 106, rigidly attached to the bracket 40, projects outwardly from the bracket and provides an uppper limit to the vertical movement permitted of the actuating member 100. A spring 120 having one end anchored to a stand-off post 122 which is rigidly fastened to the bracket 40, has its other end hooked into a suitable hole formed in the actuating member 100, thereby urging the member 100 upwardly against the under side of the stop pin 106. The stand-off post 122 is relatively long thereby permitting the anchoring of the upper end of the spring 120 a substantial distance away from the bracket 40. Since the fastener 102 retains the pivotal end of the actuating member 100 relatively close to the bracket 40, the end 104 is urged, by the action of the spring 120, outwardly and away from the bracket 40 to the position shown in FIGS. 3 and 3*a*. Note that the stop pin 106 is sufficiently long to project over the actuating member 100 and limit its upward motion as described above. A tab 130 is formed orthogonal to the actuating member 100, projecting in a direction away from the bracket 40, as shown in FIGS. 3 and 3*a*. The end 132 of the tab 130 operationally engages the cam surface 140 of the axial cam 142 which is rotationally journalled in the frame 30. A control dial 44 is rigidly attached to the cam 142 for manual actuation thereof. The control dial 144 is located on the outside of the sewing machine for convenient access by the operator. As viewed in FIG. 3*a*, the end 132 of the tab 130 is urged into abutting contact with the cam surface 140 by the action of the spring 120. In this position, the free end 104 of the actuating member 100 is positioned furthest from the bracket 40 as indicated at A in FIG. 3*a*. As the cam 142 is rotated the tab 130 is cammed toward the bracket 40 until the free end 104 is positioned as indicated at B in FIG. 4*a*.

Figure 1:
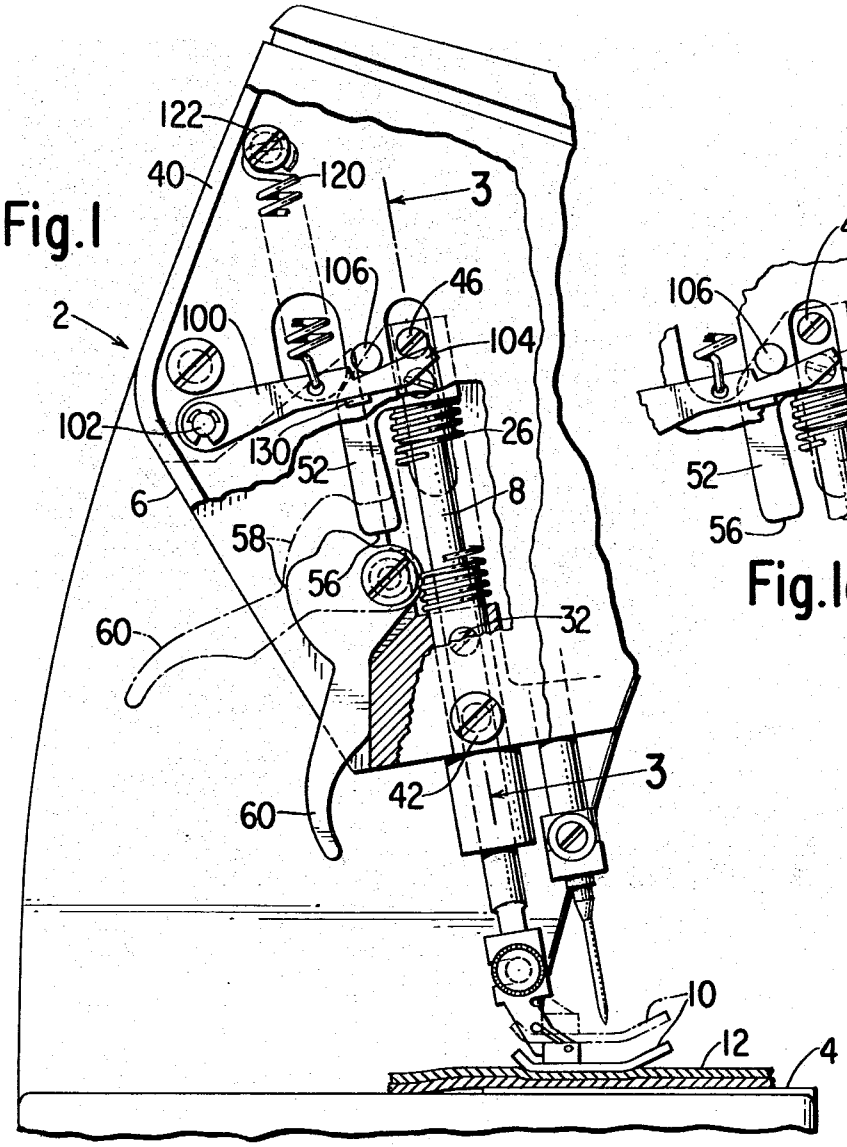
FIG. 1 is a side view of the head end of a sewing machine showing the presser bar counter balancing mechanism of the present invention.

In operation, the presser bar mechanism functions in two modes: the first being normal sewing mode where the actuating member 100 is positioned as shown in FIGS. 1, 3, and 3*a* and the second being embroidery mode where the actuating member 100 is positioned as shown in FIGS. 2, 4, and 4*a*. In normal sewing mode the control dial is rotated by the operator until the cam 142 permits the end 104 of the actuating member 100 to move to position A of FIG. 3*a*. In this position the actuating member 100 will be a substantial distance X away from the end of the guide pin 46. This provides sufficient clearance for the guide pin 46 to move downwardly with the presser bar 8 as the presser foot 10 is lowered onto the work piece 12. Note that, as viewed in FIG. 1, the work piece 12 undergoes a minor amount of compression due to the normal action of the tension spring 26 urging the presser bar 8 downwardly. In this position, the actuating member 100 is urged upwardly and against the underside of the stop pin 106. To place the sewing machine into embroidery mode, the lift lever 60 is raised so that the presser bar 8 is raised to its highest position as shown in FIG. 1*a*. Note that in this position, the guide pin 46 is vertically above the actuating member 100. The control dial 144 is then rotated until the cam 142 has cammed the tab 130 toward the bracket 40 and the end 104 is positioned as indicated at B in FIGS. 4 and 4*a*. The lift lever 60 is then lowered permitting the guide pin 46 to lower, under the biasing force of the spring 26, until the abutting surface 48 of the guide pin 46 pressingly contacts the upper surface of the actuating member 100, thereby causing the member 100 to pivot somewhat in the direction indicated by the arrow C of FIG. 2. This pivoting motion of the member 100 tends to expand the tension spring 120 until the biasing force of the spring 120 pulling up on the abutting surface 48 is substantially equal to the biasing force of the tension spring 26 pulling the collar 20 and the guide pin 46 downwardly thereby creating an equilibrium, see FIGS. 2, 4, and 4*a*. With the presser bar mechanism in equilibrium the presser foot 10 is lightly contacting the work piece 12 without imparting a compression force thereto. This facilitates manual or automated feeding movements of the work piece while preventing flagging during the embroidery operation.

As can be seen, the presser bar mechanism is of simple construction, the component parts of which are economical to manufacture and extremely simple to assemble. Further, the control dial is conveniently positioned on the outside of the sewing machine so that the operator may easily select either the normal sewing mode or the embroidery mode, as desired.

Upon reviewing the present disclosure a number of alternative constructions will occur to one skilled in the art. Such constructions may utilize actuating members of various shapes having biasing springs other than of the helical tension type. These constructions, however, are considered to be within the spirit and scope of this invention.

I claim:

1. A presser bar mechanism for a sewing machine having a frame and a work supporting surface, said mechanism having: a presser bar reciprocally movable in its axial direction; a presser foot attached to one end of said presser bar; means for urging said presser bar in a direction toward said work supporting surface; and counter balance means for urging said presser bar in a direction away from said work supporting surface comprising:

a. an actuating member;

b. an abutting surface attached to said presser bar for reciprocal movement therewith in a predefined path;

c. control means for positioning said actuating member into either of two positions, in the first of said two positions said actuating member is disposed within said predetermined path, in the second of said two positions said actuating member is disposed outside of said predefined path;

d. a spring arranged to bias said actuating member in a direction parallel to said predefined path so that when in said first of said two positions said actuating member engages said abutting surface thereby urging said presser bar in said direction away from said work supporting surface.

2. The presser bar mechanism of claim 1 wherein said actuating member comprises an elongated bar, one end of which is pivotally attached to said frame so that the other end is movable in said direction parallel to said predefined path and in a direction perpendicular thereto.

3. The presser bar mechanism of claim 1 wherein said spring is further arranged to urge said actuating member in said direction perpendicular to said predefined path.

4. The presser bar mechanism of claim 3 wherein said abutting surface comprises a surface of a cylindrical pin.

5. The presser bar mechanism of claims 1 or 4 wherein said control means comprises: a manually operable cam having a cam track; a cam follower in operational engagement with said cam track, said cam follower being attached to said actuating member; said cam track and said cam follower being arranged to impart movement to said actuating member in said direction perpendicular to said predefined path.

* * * * *